US005253904A

United States Patent [19]

Ruby

[11] Patent Number: 5,253,904

[45] Date of Patent: Oct. 19, 1993

[54] SECURITY LOCK FOR SLIDING DOOR OR WINDOW

[76] Inventor: Henry Ruby, 855 Cornwall Ave., Cheshire, Conn. 06410

[21] Appl. No.: 983,716

[22] Filed: Dec. 1, 1992

[51] Int. Cl.[5] ..... E05C 5/04

[52] U.S. Cl. ..... 292/58; 292/DIG. 46

[58] Field of Search ..... 292/58, 59, 60, 61, 292/62, 57, 251

[56] References Cited

U.S. PATENT DOCUMENTS

| | | | |
|---|---|---|---|
| 550,221 | 11/1895 | Euphrat | 292/58 |
| 1,517,817 | 12/1924 | Aufderheide | 292/61 X |
| 1,907,625 | 5/1933 | Vogt | 292/62 X |
| 3,501,932 | 3/1970 | Bishop | 70/90 |

*Primary Examiner*—Richard E. Moore
*Attorney, Agent, or Firm*—DeLio & Peterson

[57] ABSTRACT

A lock comprising a stationary sleeve, a hollow cylindrical member, a tubular member and a means for rotating the hollow cylindrical member. The stationary sleeve defines a spirally extending slot that extends its entire length. The spirally extending slot is formed between a first edge and a second edge of the stationary sleeve. The hollow cylindrical member defines an axially extending slot that extends its entire length. The hollow cylindrical member is movably positioned within the stationary sleeve. The tubular member has a projecting tab fixed thereto and is slidably disposed within the hollow cylindrical member wherein the projecting tab is slidingly engaged simultaneously within the spirally and axially extending slots. The rotating means causes the hollow cylindrical member to rotate in a first direction or in a second direction. When the hollow cylindrical member is rotated in a first direction, the projecting tab physically contacts the first edge of the stationary sleeve. This physical contact results in the exertion of a first displacing force upon the projecting tab thereby causing the tubular member to telescopically extend from the hollow cylindrical member. When the hollow cylindrical member is rotated in the second direction, the projecting tab physically contacts the second edge of the stationary sleeve. This physical contact results in the exertion of a second displacing force upon the projecting tab thereby causing the tubular member to telescopically retract into the hollow cylindrical member. The rotating means comprises a knob, which is typically controlled by a user. The displacement of the tubular member is coaxial with the knob.

18 Claims, 4 Drawing Sheets

FIG. 3
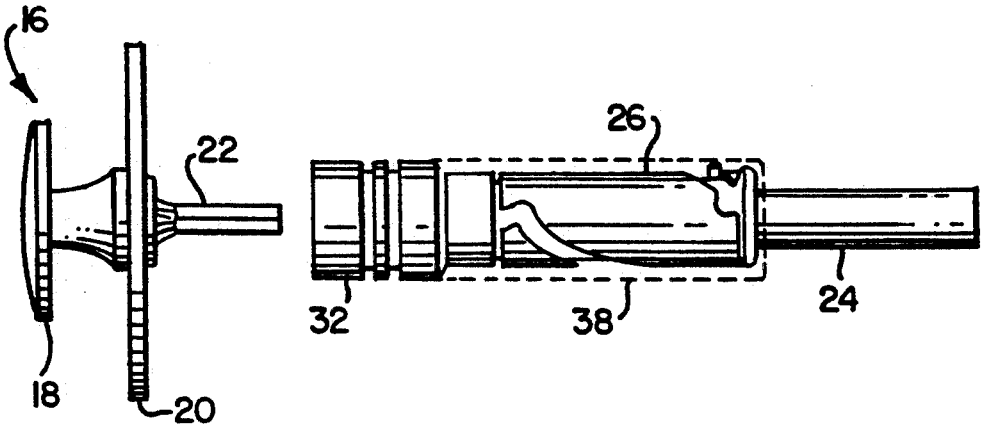
FIG. 4
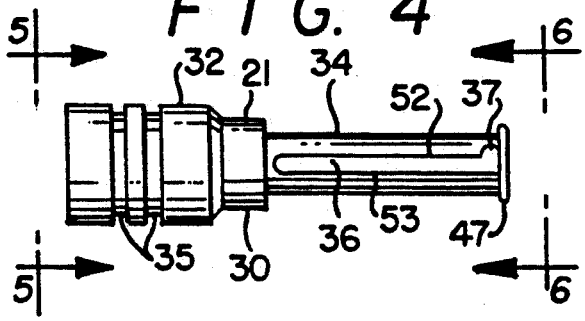
FIG. 6
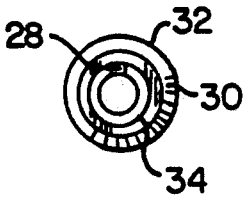
FIG. 5
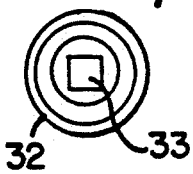
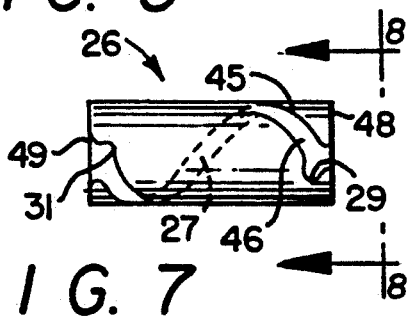
FIG. 7
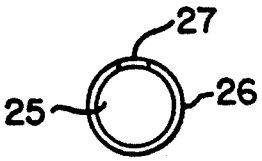
FIG. 8
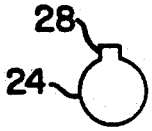
FIG. 10
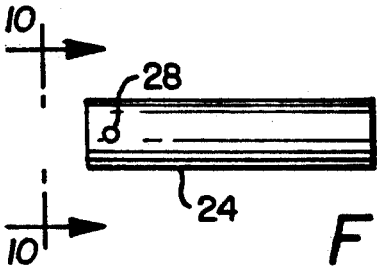
FIG. 9

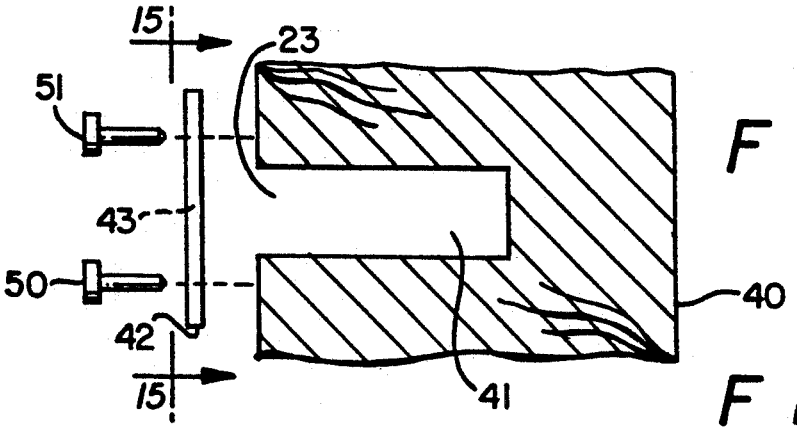
FIG. 14
FIG. 15
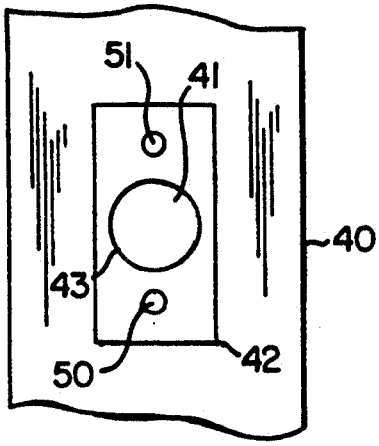
FIG. 16
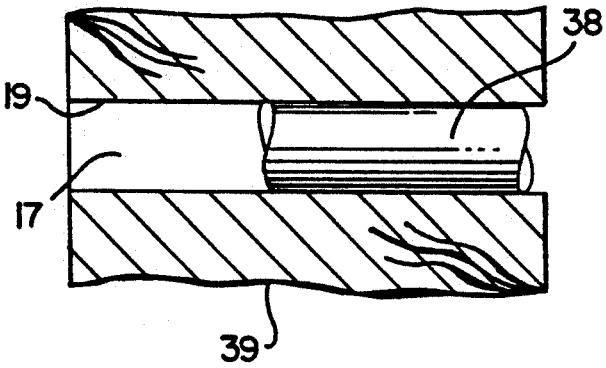
FIG. 17
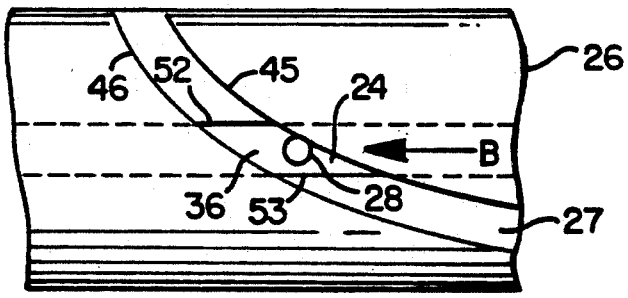
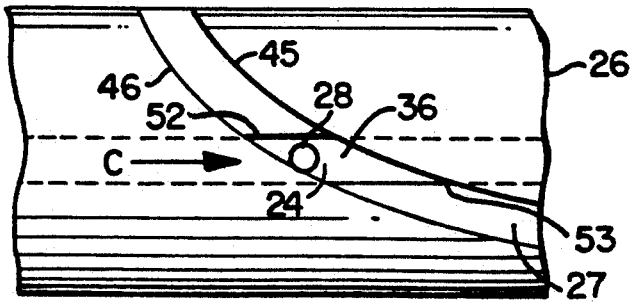
FIG. 18

SECURITY LOCK FOR SLIDING DOOR OR WINDOW

BACKGROUND OF THE INVENTION

1. Field of the Invention

The present invention relates to a lock that is utilized for selectively precluding relative movement between the sashes of sliding windows or doors.

2. Description of Related Art

Many types of locking devices have been utilized to prevent relative movement between the sashes of sliding windows or doors, however the most common type of locking device utilized is that of the combination of a pivotal element and associated stationary element. When utilized in a sliding window assembly, the pivotal element is attached to the upper surface of the lower sash of the window and the stationary element is attached to the upper surface of the lower rail of the upper sash of the window. When it is desired to lock the window, the sashes are maneuvered so as to allow a user to arrange the pivotal element so that it engages the stationary element. This conventional arrangement has many disadvantages, some of which are that it detracts from the aesthetic qualities of the window and the pivotal element can be damaged if the user applies an excessive amount of stress to it. A critical disadvantage, however, of the conventional arrangement is that it is substantially visible from outside the window and can be easily disengaged by unauthorized persons if the glass pane is broken from the window.

One attempt at addressing the above-mentioned problems is disclosed in U.S. Pat. No. 3,501,932, issued Mar. 24, 1970 entitled, "Window Lock" to Bishop. That patent describes a plunger-type mechanism wherein a plunger is telescopically received in the upper rail of the inside lower sash and insertable into a receiving space located within the lower rail of the upper outside sash, to prevent relative movement of the upper and lower sashes with respect to each other. The locking element can be moved through the upper rail of the lower inside sash by means of a key that can be selectively retained in the lock or removed from the lock when the plunger is received in the lower rail of the outside upper sash. The plunger and the receptacle of the lower rail of the upper outside sash co-act with each other when the plunger is placed in its locked position so that the upper and lower sashes are drawn toward each other and are placed into alignment with each other.

A disadvantage of the arrangement described in the Bishop patent is that a key is required to lock and unlock the window. If the key is not available, the window cannot be opened. If the key is lost, the user will incur an expense in replacing the lock or the key. Another disadvantage is that the use of the key makes locking or unlocking numerous windows in a large building a time consuming process since typically only a few people will have possession of a key. Another disadvantage is that the locking device might detract from the aesthetic qualities of an ornately and decoratively designed window.

Bearing in mind the problems and deficiencies of the prior art, it is therefore an object of the present invention to provide a locking device for locking together the sashes of sliding windows or doors whereby the windows or doors can be locked or unlocked without the use of a key.

It is another object of the present invention to provide a window or door lock that is not totally visible from outside a sliding window or door.

It is a further object of the invention to provide a window or door lock that does not detract from the aesthetic qualities of a sliding window or door.

It is yet another object of the present invention to provide a window or door lock that is of very simple construction.

SUMMARY OF THE INVENTION

The above and other objects, which will be apparent to those skilled in the art, are achieved in the present invention which is directed to a lock comprising a stationary sleeve, a hollow cylindrical member, a tubular member and a means for rotating the hollow cylindrical member. The stationary sleeve defines a spirally extending slot that extends its entire length. The spirally extending slot is formed between a first edge and a second edge of the stationary sleeve. The hollow cylindrical member defines an axially extending slot that extends its entire length. The hollow cylindrical member is movably positioned within the stationary sleeve. The tubular member has a projecting tab fixed thereto and is slidably disposed within the hollow cylindrical member wherein the projecting tab is slidingly engaged simultaneously within the spirally and axially extending slots. The rotating means causes the hollow cylindrical member to rotate in a first direction or in a second direction.

In a preferred embodiment, when the hollow cylindrical member is rotated in a first direction, the projection tab physically contacts the first edge of the stationary sleeve. This physical contact results in the exertion of a first displacing force upon the projecting tab thereby causing the tubular member to telescopically extend from the hollow cylindrical member. When the hollow cylindrical member is rotated in the second direction, the projecting tab physically contacts the second edge of the stationary sleeve. This physical contact results in the exertion of a second displacing force upon the projecting tab thereby causing the tubular member to telescopically retract into the hollow cylindrical member. The rotating means comprises a knob, which is typically controlled by a user. The displacement of the tubular member is coaxial with the knob.

BRIEF DESCRIPTION OF THE DRAWINGS

For a fuller understanding of the invention, reference should be made to the following description taken in connection with the accompanying drawings, in which:

FIG. 3 is a side elevational view, partially exploded, of the lock assembly in accordance with the present invention.

FIG. 4 is side elevational view, of the body portion and hollow cylindrical member of the lock assembly of FIG. 3.

FIG. 5 is an end view of the body portion of FIG. 4.

FIG. 6 is an end view of the hollow cylindrical member shown in FIG. 4.

FIG. 7 is a side elevational view of the sleeve for the lock depicted in FIG. 3.

FIG. 8 is an end view of the sleeve of FIG. 7.

FIG. 9 is a side elevational view of the tubular member, with a metal projecting tab fixed thereto, for the lock assembly depicted in FIG. 3.

FIG. 10 is an end view of the tubular member of FIG. 9.

FIG. 14 is a side elevational view, partially exploded, in cross section, of a sash protector plate and the manner in which it is associated with the receiving space within the outside sash of the sliding door assembly of FIG. 1.

FIG. 15 is a front elevational view of the sash protector plate of FIG. 14 positioned over the opening of the receiving space within the outside sash.

FIG. 16 illustrates a space within the inside sash of the sliding door assembly of FIG. 1 that receives the lock assembly of FIG. 3.

FIGS. 17 and 18 illustrate the interaction between the metal projecting tab fixed to the tubular member of FIG. 9 and the edges of the sleeve of FIG. 7.

DESCRIPTION OF THE PREFERRED EMBODIMENT

Figure 1:
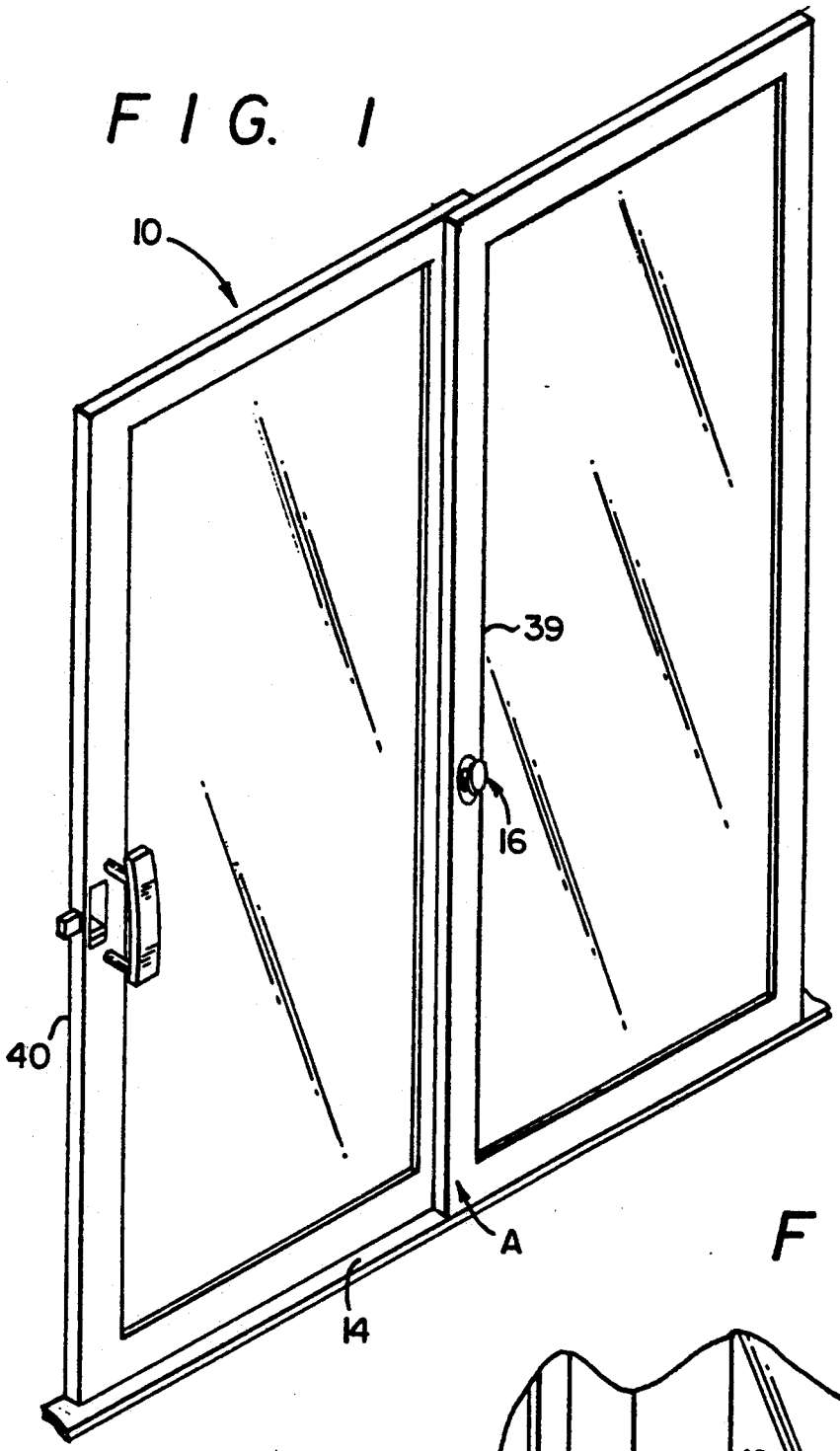
FIG. 1 is a perspective view of a standard sliding door having inside and outside sashes and utilizing the lock of the present invention.
Figure 2:
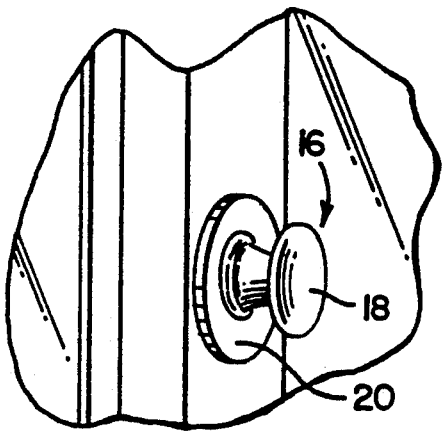
FIG. 2 is an enlarged perspective view of the exterior of the lock depicted in FIG. 1.

In describing the preferred embodiment of the present invention, reference will be made herein to FIGS. 1–18 of the drawings in which like numerals refer to like features of the invention. Features of the invention are not necessarily shown to scale in the drawings.

Although the lock of the present invention is for use in sliding doors and sliding windows, the following description pertains to utilization of the present invention in sliding door assembly 10 shown in FIG. 1. Inside and outside sashes 39 and 40 respectively slide on track 14 to a desired configuration. Lock 16 is located in the center portion of inside sash 39, however it can also be located at the bottom end of inside sash 39 designated by the letter A. As shown in FIGS. 3–9, lock 16 comprises a knob 18, knob support plate 20, elongated member 22, body portion 32, hollow cylindrical member 34, first sleeve 26, tubular member 24, and second sleeve 38.

Hollow cylindrical member 34 defines an axially extending slot 36 that extends its entire length. Axially extending slot 36 is bordered by edges 52 and 53 of hollow cylindrical member 34. Edge 48 has a notch 37 therein which is adjacent to rib 47. Tubular member 24 has outwardly projecting tab or dowel 28 fixed thereto and is slidably disposed within hollow cylindrical member 34 such that projecting tab 28 is slidingly engaged within axially extending slot 36. Tubular member 24 is rigid plastic, however metal is also suitable. Projecting tab 28 is preferably metal for strength and durability. Sleeve 26 defines a spirally extending slot 27 that extends its entire length. Spirally extending slot 27 is bordered by edges 45 and 46 of sleeve 26. Edge 45 has notch 31 therein at end 49 of sleeve 26 and edge 46 has notch 29 at end 48 of sleeve 26. Hollow cylindrical member 34 slideably receives sleeve 26 around it such that projecting tab 28 is slidingly engaged simultaneously with axially extending slot 36 and spirally extending slot 27. Sleeve 26 must be slightly expanded so it can be inserted over circumferential rib 47 of hollow cylindrical member 34. Rib 47 keeps sleeve 26 positioned over hollow cylindrical member 34 as the sleeve rotates. Sleeve 26 is fabricated from thin sheet metal and should have resilient characteristics. Hollow cylindrical member 34 is fixed to end 30 of body portion 32. Circumferential grooves 35 are formed in body portion 32 so as to create a tight fitting relationship with inner surface 19 of receiving space 17 of sash 39 (see FIG. 16) and still allow body portion 32 to rotate within sash 39. Body portion 32 has a square cavity 33 therein for slideably receiving square elongated member or shaft 22. Square elongated member 22 is fixed to knob 18, which is rotatably mounted on knob support plate 20.

To mount the lock into the door or window sash, sleeve 38 is placed within a cylindrical hole 17 drilled through sash 39 and defines an opening therein facing opposite sash 40. Sleeve 38 receives sleeve 26, hollow cylindrical member 34, and end 30 of body portion 32. End 30 of body portion 32 is formed to have longitudinally extending ribs 21 on its outer surface thereby enabling end 30 to be frictionally inserted into sleeve 38. End 30 is also beveled enabling the outer surface of sleeve 38 to be flush with the outer surface of body portion 32 (see FIG. 3). Spirally extending slot 27 allows sleeve 26 to be compressed when it is being inserted into sleeve 38. Once inserted, sleeve 26 expands back to its normal shape so as to be firmly held in a stationary position within sleeve 38. A cylindrical hole 41 is drilled in outside sash 40 to receive tubular member 24 when the sashes 39, 40 are closed. In the closed position, knob member 22, tubular member 24 and opening 41 are coaxially aligned.

Figure 12:
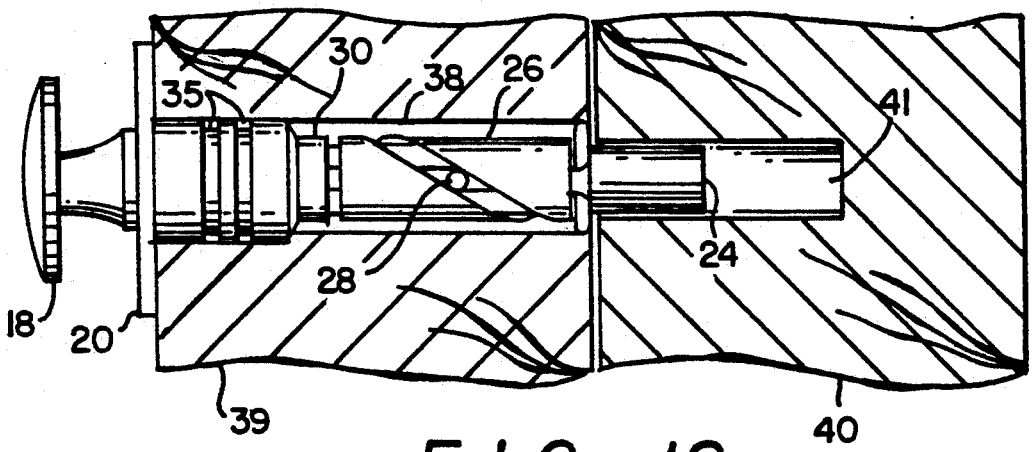
FIG. 12 is a side elevational view, in cross section, of the lock assembly of FIG. 3 configured in a manner such that the tubular member of FIG. 9 is partially extended into a receiving space within the outside sash of the sliding door assembly of FIG. 1.
Figure 13:
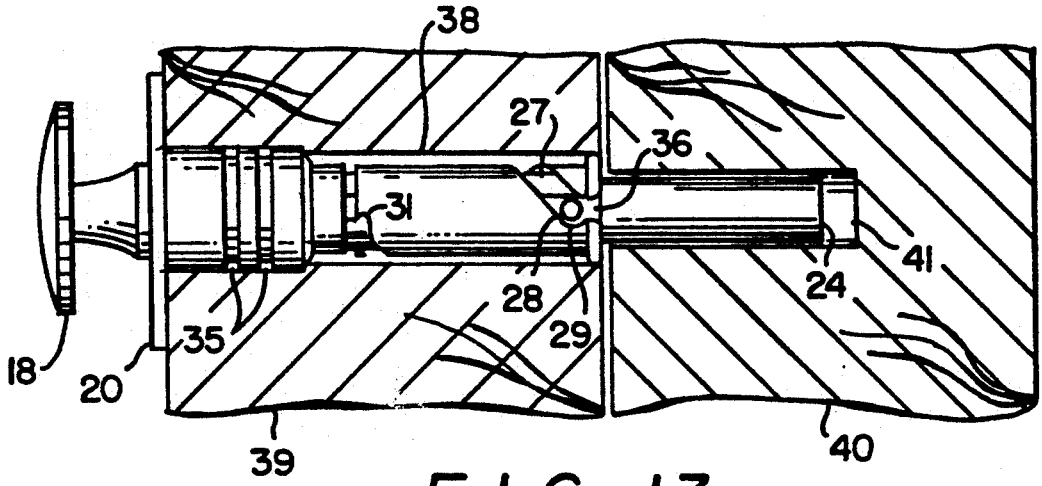
FIG. 13 is a side elevational view, in cross section, of the lock assembly of FIG. 3 configured in a manner such that the tubular member of FIG. 9 is totally extended into the receiving space within the outside sash of the sliding door assembly of FIG. 1.

Referring to FIGS. 12, 13 and 17, when the user rotates knob 18 in a clockwise direction, projecting tab 28 physically contacts edge 45 of sleeve 26. This physical contact results in the exertion of a displacing force upon projecting tab 28 thereby causing tubular member 24 (represented by the cross-hatched area in FIG. 17) to telescopically extend in the direction designated by arrow B and enter into receiving space 41 of outside sash 40. Tubular member 24 continues to telescopically extend until projecting tab 28 becomes substantially enveloped by the combination of notch 37 of hollow cylindrical member 34 and notch 29 of sleeve 26, thereby precluding further movement of tubular member 24 and hence, precluding further rotation of knob 18 by the user. Tubular member 24 is fully extended into receiving space 41 of outside sash 40 (see FIG. 13) when projecting tab 28 becomes substantially enveloped by notches 37 and 29.

Figure 11:
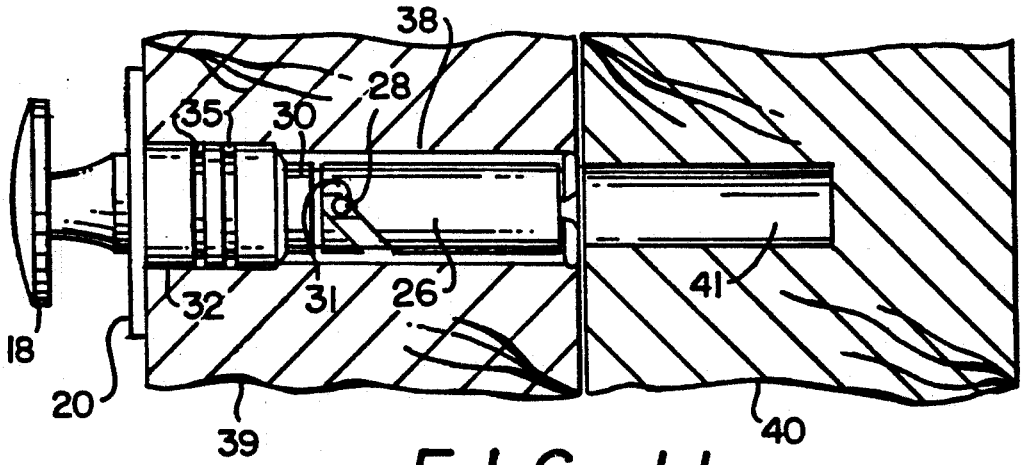
FIG. 11 is a side elevational view, in cross section, of the lock assembly of FIG. 3 configured in a manner such that the tubular member of FIG. 9 is totally retracted and disposed within the hollow cylindrical member of FIG. 4.

Referring to FIGS. 11 and 18, when the user rotates knob 18 in a counterclockwise direction, projecting tab 28 physically contacts edge 46 of sleeve 26. This physical contact results in the exertion of a displacing force upon projecting tab 28 thereby causing tubular member 24 (represented by the cross-hatched area in FIG. 18) to telescopically retract in the direction designated by arrow C and withdraw into hollow cylindrical member 34. The motion of tubular member 24 continues until projecting tab 28 becomes partially enveloped by notch 31 of sleeve 26 and edge 53 of hollow cylindrical member 34 thereby precluding further movement of tubular member 24 and hence, precluding further rotation of knob 18 by the user. Tubular member 24 is totally disposed within hollow cylindrical member 34 (see FIG. 11) when projecting tab 28 becomes partially enveloped by notch 31 and edge 53. The displacement of tubular member 24 is coaxial with knob 18.

Sash protector plate 42 is utilized to prevent deterioration of the surface surrounding opening 23 of receiving space 41 (see FIG. 14). Sash protector plate 42 is fixed to outside sash 40 in such a manner that sash protector plate opening 43 is aligned with opening 23. Screws 50 and 51 are utilized to fasten sash protector plate 42 to outside sash 40 (see FIG. 15).

While a preferred embodiment of the invention has been disclosed in detail, it should be understood by those skilled in the art that various modifications may be made to the illustrated embodiment without departing from the scope of the invention. The invention is thus not to be construed to be limited only to the disclosed embodiment, but it is instead intended to be limited only as defined by the appended claims.

Thus, having described the invention, what is claimed is:

1. A locking apparatus, comprising:

a first sleeve defining a spirally extending slot that extends along its length, said spirally extending slot formed between first and second edges of said first sleeve;

means for holding said first sleeve stationary;

a hollow cylindrical member defining an axially extending slot that extends along its length, said hollow cylindrical member being rotatably disposed within said first sleeve;

a tubular member having a projecting tab fixed thereto, said tubular member being slidably disposed within said hollow cylindrical member, wherein said projecting tab is slidingly engaged simultaneously within said spirally and axially extending slots; and means for rotating said hollow cylindrical member either in a first direction or a second direction whereby when said hollow cylindrical member is rotated in said first direction, said projecting tab contacts an edge of said first sleeve whereby said contact results in a first force being exerted on said projecting tab thereby causing said tubular member to telescopically extend from said hollow cylindrical member and when said hollow cylindrical member is rotated in said second direction, said projecting tab contacts an edge of said first sleeve whereby said contact results in a second force being exerted on said projecting tab thereby causing said tubular member to telescopically retract into said hollow cylindrical member.

2. The locking apparatus as set forth in claim 1 and further including a body portion fixed to said hollow cylindrical member.

3. The locking apparatus as set forth in claim 2 wherein said rotating means comprises a knob means fixed to said body portion.

4. The locking apparatus as set forth in claim 3 wherein rotation of said hollow cylindrical member displaces said tubular member coaxially with said knob means.

5. A locking apparatus for selectively precluding relative movement between the sashes of a sliding door or window, comprising;

a first sleeve defining a spirally extending slot that extends along its length, said spirally extending slot bordered by a first edge and a second edge of said first sleeve, said first sleeve having a first end and a second end;

a hollow cylindrical member defining an axially extending slot that extends along its length, said hollow cylindrical member being movably positioned within said first sleeve;

a tubular member having a projecting tab fixed thereto, said tubular member being slidably disposed within said hollow cylindrical member, wherein said projecting tab is slidingly engaged simultaneously within said spirally and axially extending slots;

a second sleeve for placement in one of said sashes and defining a first opening therein facing said other sash, said second sleeve receiving said first sleeve and said hollow cylindrical member, said spirally extending slot allowing said first sleeve to be compressed when inserted into said second sleeve and expanded when fully inserted so as to be firmly positioned within said second sleeve; and means for rotating said hollow cylindrical member either in a first direction or a second direction whereby when said hollow cylindrical member is rotated in said first direction, said projecting tab contacts an edge of said first sleeve which results in the exertion of a first displacing force upon said projecting tab thereby causing said tubular member to telescopically extend from said hollow cylindrical member and enter into a second opening within said other sash and when said hollow cylindrical member is rotated in a second direction, said projecting tab contacts an edge of said first sleeve which results in the exertion of a second displacing force upon said projecting tab thereby causing said tubular member to telescopically retract into said hollow cylindrical member.

6. The locking apparatus as set forth in claim 5 wherein one end of said hollow cylindrical member has a circumferential rib thereon for retaining said first sleeve over said hollow cylindrical member.

7. The locking apparatus as set forth in claim 6 wherein said first edge of said first sleeve has a first notch therein located at said first end of said first sleeve and said second edge of said first sleeve has a second notch therein located at said second end of said first sleeve.

8. The locking apparatus as set forth in claim 7 wherein said axially extending slot is formed between a first edge and a second edge of said hollow cylindrical member, said first edge of said hollow cylindrical member having a third notch therein adjacent to said rib, said first notch and said third notch substantially enveloping said projecting tab when said tubular member is fully extended from said hollow cylindrical member, said second notch and said second edge of hollow cylindrical member substantially enveloping said projecting tab when said tubular member is completely retracted within said hollow cylindrical member.

9. The locking apparatus as set forth in claim 5 and further including a body portion fixed to said hollow cylindrical member.

10. The locking apparatus as set forth in claim 9 wherein said rotating means comprises a knob means fixed to said body portion.

11. The locking apparatus as set forth in claim 10 wherein rotation of said hollow cylindrical member displaces said tubular member coaxially with said knob means.

12. The locking apparatus as set forth in claim 10 wherein said knob means is rotatably mounted on a knob support plate, said knob support plate being adapted to be securely mounted on said one of said sashes.

13. The locking apparatus as set forth in claim 5 wherein said tubular member is made of rigid plastic.

14. The locking apparatus as set forth in claim 5 wherein said first sleeve is made of metal.

15. The locking apparatus as set forth in claim 5 and further including a sash protector plate having an opening therein, said plate being fixed to said other sash so that said plate opening is aligned with said second opening, said plate preventing deterioration of said other sash in an area surrounding said second opening.

16. The locking apparatus as set forth in claim 9 wherein said body portion has a beveled end with longitudinally extending ribs formed thereon for frictionally receiving said second sleeve.

17. A locking apparatus for selectively precluding relative movement between the sashes of a sliding door or window, comprising:

a first sleeve defining a spirally extending slot that extends its entire length, said spirally extending slot bordered by a first edge and a second edge of said first sleeve;

a hollow cylindrical member defining an axially extending slot that extends its entire length, said hollow cylindrical member being movably positioned within said first sleeve, said member having a rib thereon for retaining said first sleeve over said hollow cylindrical member;

a body portion having a cavity therein, said body portion being fixed to one end of said hollow cylindrical member;

a tubular member having a dowel fixed thereto, said tubular member being slidably disposed within said hollow cylindrical member, wherein said dowel is slidingly engaged simultaneously within said spirally and axially extending slots;

a second sleeve for placement in one of said sashes and defining a first opening therein facing said other sash, said second sleeve receiving said first sleeve and said hollow cylindrical member, said spirally extending slot allowing said first sleeve to be compressed when inserted into said second sleeve and expanded when fully inserted so as to be firmly positioned within said second sleeve; and a knob fixed to an end of said body portion opposite to said end fixed to said hollow cylindrical member, said knob rotating said body portion and hollow cylindrical member either in a first direction or in a second direction whereby when said hollow cylindrical member is rotated in said first direction, said dowel contacts said first edge of said first sleeve which results in the exertion of a first displacing force upon said dowel thereby causing said tubular member to telescopically extend from said hollow cylindrical member and enter into a second opening within said other sash and when said hollow cylindrical member is rotated in a second direction, said dowel contacts said second edge of said first sleeve which results in the exertion of a second displacing force upon said dowel thereby causing said tubular member to telescopically retract into said hollow cylindrical member, said tubular member being displaced coaxially with said knob.

18. The locking apparatus as set forth in claim 17 wherein said knob is rotatably mounted on a knob support plate, said knob support plate being adapted to be securely mounted on said one of said sashes.

* * * * *